United States Patent [19]

Henning

[11] Patent Number: 4,606,092

[45] Date of Patent: Aug. 19, 1986

[54] LIQUID-VACUUM WASHER FOR BASEBOARD CORNER

[76] Inventor: John J. Henning, 910 Crestview, Palatine, Ill. 60007

[21] Appl. No.: 693,642

[22] Filed: Jan. 22, 1985

[51] Int. Cl.[4] ..... A47L 11/30

[52] U.S. Cl. ..... 15/322; 15/374; 15/401; 15/420

[58] Field of Search ..... 15/321, 322, 374, 401, 15/420

[56] References Cited

U.S. PATENT DOCUMENTS

| | | | |
|---|---|---|---|
| 3,538,535 | 11/1970 | Ginsburgh et al. | 15/322 X |
| 3,896,521 | 7/1975 | Parise | 15/322 X |
| 4,161,802 | 7/1979 | Knight et al. | 15/322 X |

FOREIGN PATENT DOCUMENTS

| | | | |
|---|---|---|---|
| 114926 | 8/1984 | European Pat. Off. | 15/321 |

*Primary Examiner*—Chris K. Moore

*Attorney, Agent, or Firm*—Charles F. Lind

[57] ABSTRACT

The disclosed spray-vacuum tool has a partitioned housing with two adjacent open faces, and defines adjacent liquid and vacuum chambers each open to both open housing faces. A pair of squeegees project beyond the open housing faces from opposite housing sides paralleling the partition, and each squeegee is angled across a sharp angle corresponding to the corner angle. A pair of end guides also project beyond the open housing faces from the other interconnecting housing sides, and the squeegee ends are butted flush against the end guides. Each end guide has a flat edge to be fitted flush against one of the respective surfaces to be cleaned, and the squeegees then are flexed then against the surfaces to be cleaned. This communicates the chambers together in the region adjacent the surfaces to be cleaned, but isolates this region from the tool exterior. Nozzle means in the liquid chamber spray washing and/or rinsing liquid directly against the surfaces to be cleaned; and a source of vacuum is connected, via a hollow wand swiveled at one end to the housing, to the vacuum chamber operable to draw away the liquid spray and dirt kicked up by the spray. A brush also having the angled corner shape is supported in the liquid chamber immediately adjacent the squeegee.

8 Claims, 5 Drawing Figures

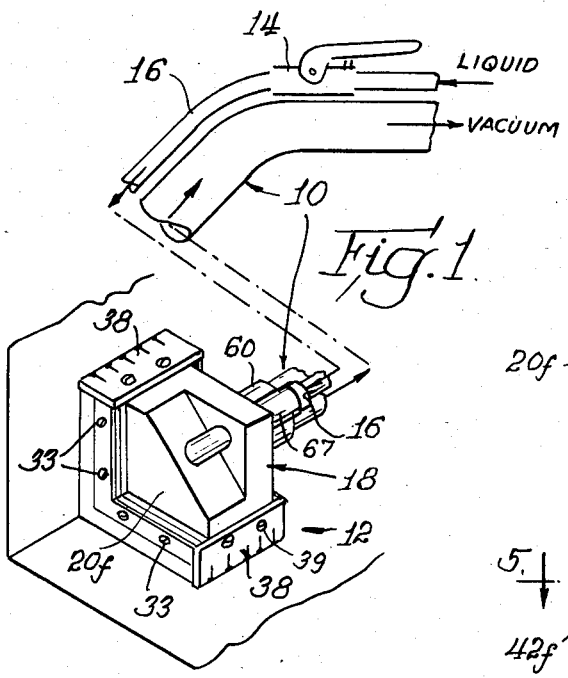
Fig. 1
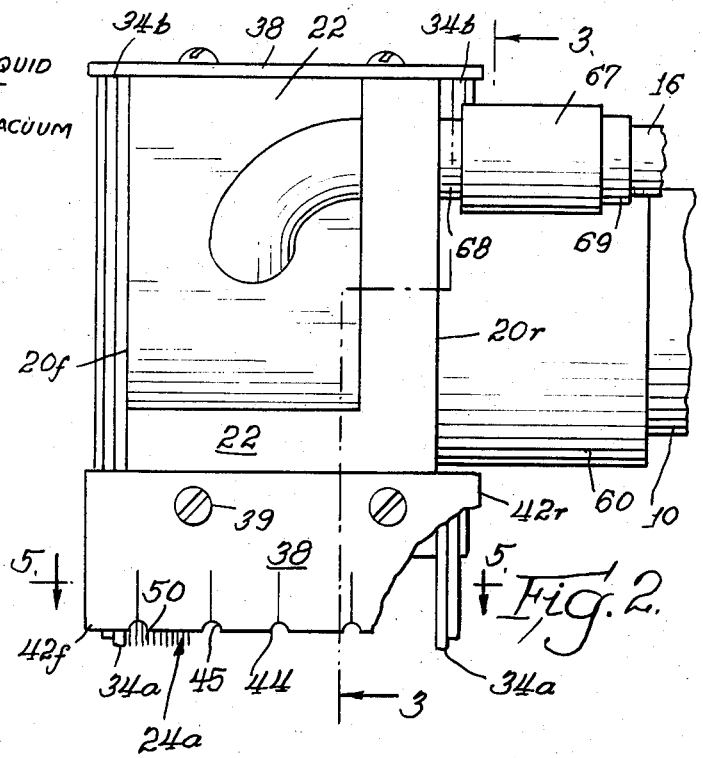
Fig. 2
Fig. 5
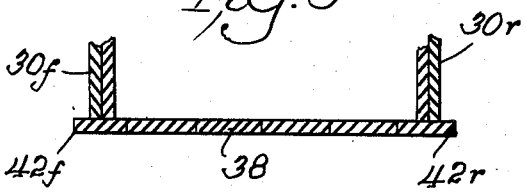
Fig. 3
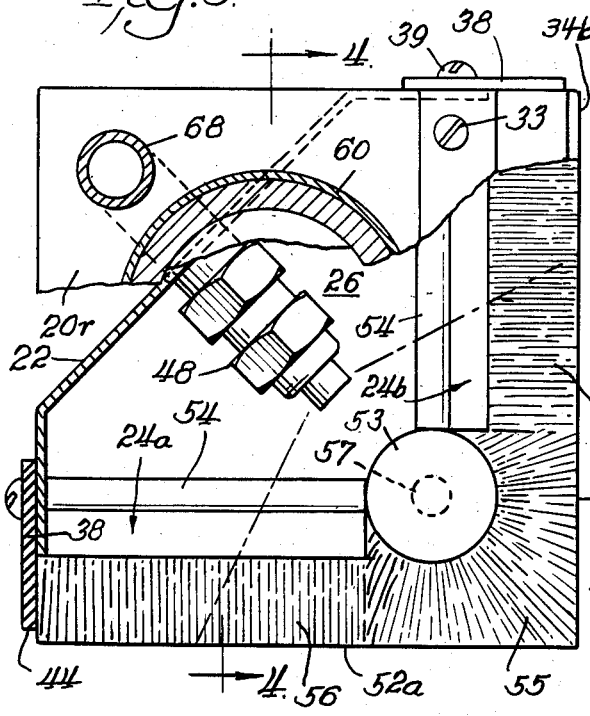
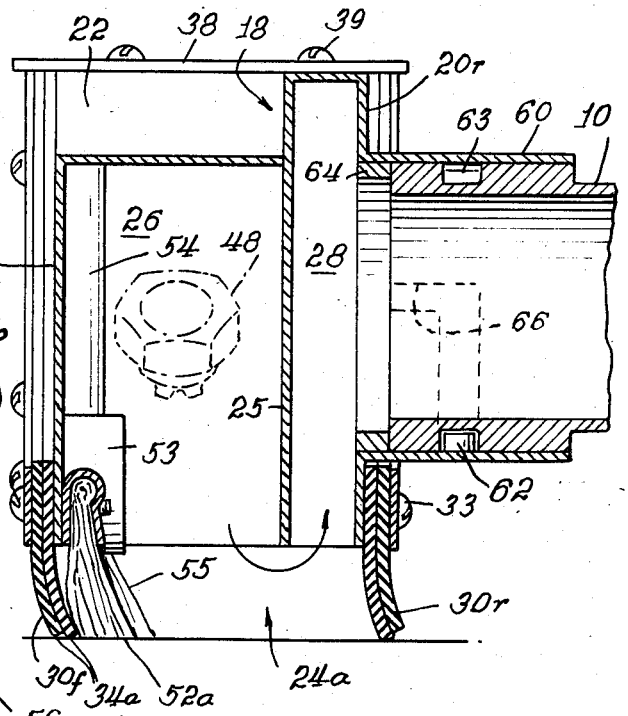
Fig. 4

LIQUID-VACUUM WASHER FOR BASEBOARD CORNER

RELATED INVENTIONS AND COPENDING APPLICATIONS

Two other applications for patents are being filed concurrently herewith for my related inventions: respectively entitled Liquid-Vacuum Washer for Walls, which relates to a tool specifically designed to clean walls Ser. No. 693,625, filed 1/22/85, and Liquid-Vacuum Washer for Hard Surfaces, which relates to a tool specifically designed to clean hard surfaces, such as tile, cement or even glass Ser. No. 693,630, filed 1/22/85.

BACKGROUND OF THE INVENTION

Commerical cleaning services for offices or the like are generally considered a very high labor intensitive industry. Consequently, every labor saving device could represent a significant increase of productivity, and a resultant improved profit for anyone in such a business.

One device used to help clean carpets is the "steam cleaner"; using some type of cleaning liquid that is applied to the carpet and a tool that is moved along on the surface and connected to a source of vacuum so as to draw excess liquid out of the carpet. Devices of this type are referred to herein as spray-vacuum systems. The tool used on carpets has spaced generally flat surfaces that ride flush on the top of the carpet, and that define therebetween a slot open to the carpet and connected to the source of vacuum. The cleaning liquid is frequently sprayed directly onto the carpet, from outside the tool.

While the above-described tool works well on carpets generally, it does not work well for cleaning bare floors, such as exposed wood, tile or cement; and accordingly different tool concepts have been proposed for this. However, they generally have been wanting. Some tools, for example, are effective in moving in one direction only; so that repeated cleaning passes are needed in order to effectively clean the surface or to draw away the liquid. Most sysems apply the cleaning liquid in the open atmosphere so that the liquid can end up beyond the areas intended. Some systems apply the liquid by rolling or rubbing it on the surface, so that they are slow or are not effective in driving dirt from the bottoms of holes or grooves, such as are common in patterned tile floors or in the grout seams. Some systems or tools are just too bulky to be moved about freely and into hard-to-reach locations, such as against the wall or against or under a piece of furniture.

Of concern then, is the ability to use the spray-vacuum system on a wide range of types of surfaces, with a reasonable number of separate tool pieces, and at a reasonable investment of equipment. If a specialized tool is used, it should be as multi-functional as possible and/or be interchangable with other tools and operable off the same basic spray-vacuum system.

Of concern also is the ability to clean the surfaces meeting across an interior or baseboard corner; especially where the surfaces again are hard.

On the whole, known spray-vacuum tools for this purpose: (1) provide poor cleaning preformance, in that much of the dirt remains on the surface even after being sprayed and vacuumed; (2) are messy with excess liquid spraying beyond the area to be cleaned; and (3) are slower that expected with the consequential reduction in the anticipated productivity.

SUMMARY OF THE INVENTION

This invention relates to a tool to be used with a liquid spray-vacuum cleaning system, and is particularly effective for cleaning a hard, relatively nonabsorbent surface such as tile or cement.

A basic object of thus invention is to provide a tool that can be used with a minimum of messy spills of washing or rinsing liquid beyond that area intended to be cleaned, to ease in the cleanup, as well as to avoid damage to nearby items of furniture or the like.

Another object of this invention is to provide a cleaning tool that is particularly effective in drawing out the dirt or the like by blasting it loose from the surface with a high pressure spray in a containment of the tool housing cavity, by mechanically brushing the surface to even further dislodge the dirt, and by drawing away the spray mist and dirt held in suspension therewith via the same containment cavity.

Yet another object of this invention is to provide a cleaning tool that can be operated in both directions of a back and forth stroke, so as to be fast but effective; and moreover that can be operated in close or tight working quarters but yet right up to the vertical surface or wall, so as to be effective and minimize any required hand touchup cleaning.

Yet another object of this invention is to provide a cleaning tool that is manually supported at the end of a wand in the spray-vacuum system, and that is interchangable with other tools of the related system for increased effectiveness and economy.

A specific object of this invention is to provide a cleaning tool for cleaning surfaces, formed generally of a hard nonabsorbent material, at and across the interior corner where the surfaces meet, such as the baseboard corner between a tile floor and a tile wall, without leaving a mess or having to made repeated passes or strokes over the surface.

BRIEF DESCRIPTION OF THE DRAWINGS

FIG. 1 is a perspective view of a wand used with a liquid-vacuum cleaning system, and showing the improved tool mounted thereon;

FIG. 2 is an elevational view of the improved tool of FIG. 1, shown partly broken away and in section for clarity of disclosure;

FIG. 3 is a sectional view of the improved tool, as seen generally from line 3—3 in FIG. 2;

FIG. 4 is a sectional view, as seen generally from line 4—4 in FIG. 3; and

FIG. 5 is a sectional view, as seen generally from line 5—5 in FIG. 2.

DETAILED DESCRIPTION OF THE INVENTION

A typical spray-vacuum cleaning system uses a source of high pressure cleaning and/or rinsing liquid, such as would generally be held in a tank and pressurized by conventional pump means. Valve means is then used to selectively control discharge of the liquid from the tank to a cleaning tool for washing and rinsing the surface to be cleaned. Also, a source of vacuum is typically provided, such as at the inlet of a conventional blower. An on-off switch would generally be used to power the blower motor to control the blower operation. A wand is used for communicating the vacuum source to the tool itself, which is typically carried at the free end of the wand. The disclosed invention relates to an improved spray-vacuum tool particularly effective to clean the surfaces meeting across an interior corner, more commonly along the baseboard between the floor and a vertical wall but also possibly between two vertical walls.

FIG. 1 illustrates a wand 10 holding a tool 12, with the sources of liquid and vacuum also being idenified. A trigger control 14 is shown on the wand 10 and would be connected to the valve means (not shown) in the liquid line 16 extending between the source of the high pressure liquid and the tool 12. Appropriate finger manipulation of the trigger control 14 will thus be effective in selectively controlling flow of the high pressure liquid to the tool 12.

The improved tool 12 has a housing 18 with spaced front and rear side walls 20*f* and 20*r*, respectively and top and end walls 22 extending between and interconnecting the side walls, so as to define together an interior cavity that is open along two adjacent faces 24*a* and 24*b*. A partition 25 divides the cavity into adjacent liquid and vacuum chambers 26 and 28 respectively, each open to both open housing faces 24*a* and 24*b*. A pair of squeegees 30*f* and 30*r* are secured to the housing side walls 20*f* and 20*r*, as by bolts 33, and project beyond the open housing faces 24*a* and 24 *b* so as to be parallel to the partition 25. Each squeegee 30*f* and 30*r* has wiping edges 34*a* and 34*b* that meet across a sharp exterior angle, generally a right angle, corresponding to the interior right angle between the typical corner surfaces to be cleaned. Consequently, one pair of the straight edges (34*a* for example) will contact one of the surfaces to be cleaned and the other pair of straight edges (34*b* in the example noted) will contact the other surface to be cleaned.

A pair of end guides 38 are also secured, as by bolts 39, to the housing 18 at the interconnecting end walls 22, and project beyond the open housing faces 24*a* and 24*b*, but somewhat less than the squeegees 30 project. The end guides 38 extend slightly beyond the ends of the squeegees 30*f* and 30*r*, as at ends 42*f* and 42*r*, and the squeegees extend at their ends flush against the flat inside face of the end guides 38. Each end guide 38 also has a flat edge 44 adapted to fit flush against the surface to be cleaned, and small cutouts or notches 45 are formed in each edge 44.

With this end guide-squeegee configuration, the wiping edges 34*a* and 34*b* of the squeegees 30*f* and 30*r*, and the edges 44 of the end guides 38 simultaneously will contact the surfaces to be cleaned only when the squeegees are somewhat flexed (as is illustrated in FIG. 4) to be in a good wiping orientation relative to the surfaces to be cleaned. With the end guides 38 and squeegees 30 all engaging the surfaces to be cleaned, they together define an extension of the housing cavity and operate both to isolate the liquid and vacuum chambers 26 and 28 interiorly of the tool, and to communicate the chambers together in the region adjacent the surfaces to be cleaned.

Nozzle means 48 is in the liquid chamber 26, being connected to the liquid line 16, and operates to spray the cleaning liquid directly against the surfaces to be cleaned. Brush means 50 is supported in the liquid chamber 26 of the housing, immediately adjacent the squeegee 30*f*, and has bristles that terminate alone substantially straight edges 52*a* and 52*b* that together meet across a right-angled exterior corner. Thus one straight edge (52*a* for example) will contact one of the surfaces to be cleaned and the other straight edge (52*b* in the example given) will contact the other surface to be cleaned.

The disclosed brush means 50 is formed of two types of brushes: a cylindrical brush 53 located immediately at or proximate the corner to be cleaned, and two short straight brushes 54 located outwardly adjacent the cylindrical brush. The straight brushes 54 have bristles 56 of uniform length that project generally perpendicular to the surfaces to be cleaned; while the cylindrical brush 53 has bristles 55 that vary somewhat in length, and that are angled relative to the surfaces at all locations except the two locations where they also extend perpendicular to the surfaces. However, the bristles 55 and 56 do extend to the surfaces to be cleaned, even at and across the corner. The cylindrical brush 53 also entends with its axis parallel to but offset from the line defined by the corner itself, and has a length somewhat longer than the thickness of the straight brushes 54, to provide greater bristle density right at and immediately adjacent the corner. This enhances the brushing ability of the tool, both on the flat surfaces adjacent the corner and at the corner itself. As illustrated, the cylindrical brush 53 is held in place to the housing by a bolt 57; while the straight brushes 54 can be held in place to the housing by the bolts 33 that also hold the squeegee 30*f* to the housing.

As disclosed, the wand 10 is received in a tubular sleeve 60 of the housing and held axially therein by a swivel connection including a pin 62 formed on the tool sleeve and trapped in a circumferential slot 63; with the end of the wand then also being close to and probably contacting a stop 64 formed on the sleeve 60. This allows free swivelling of the tool, while also providing a relatively nonwobbling fit between the tool and wand. The tool 12 is designed to be removable from the wand 10 to allow the wand and its connected spray-vacuum system to be used with other compatible tools, as disclosed in my cofiled application entitled Liquid-Vacuum Washer for Hard Surfaces, Ser. No. 693,630. To accommodate this, an axial slot 66 is also formed in the wand to extend to the circumferential slot 63, to allow the pin 62 to be passed along this slot to or from the circumferential slot. To minimize accidential disengement of the tool from the wand, the pin 62 cooperates with the axial slot 66 only when the tool is rotated about the axis of the sleeve almost 180 degrees from its normal in-use orientation relative to the wand. Also, to be compatible with the tools disclosed in my cofiled application, there is a conventional two-part quick disconnect coupling 67 provided in the liquid line 16 immediately adjacent the tool, with one part 68 of the coupling remaining with the tool and with the other part 69 remaining with the wand.

The swivel connection allows the tool 12 to be angled relative to the supporting wand 10 while yet retaining close proximate contact with the surfaces to be cleaned, or to be moved along or past a piece of furniture while yet being right against the wall surface to be cleaned. Of greater significance however, in allowing the placement and movement of the tool operatively next to the wall is the squeegee location near the side edge of the tool, and only the slight projection of the end guides beyond the squeegee. Each end guide projection is of the order of between 0.05 and 0.2 inches. Thus, the tool can be moved along the corner almost up to the next wall angled transverse to the corner, with the front squeegee 30*f* almost to the wall.

It will be appreciated that this tool is most effective in cleaning corners between hard meeting surfaces, such as formed of tile or cement; and even works to clean out patterned holes or grooves, or grouted regions, in the surfaces. This is because of the direct spraying action against the surface, within the confinement of the housing cavity, and because of effective surface brushing during the spraying. Moreover, inasmuch as the vacuum and liquid chambers are interconnected via the cavity containment, any dirt or debris kicked up with the spraying or brushing can be immediately drawn away through the vacuum chamber and related vacuum system. The cutouts 45 in the end guides allow for the infeed of makeup air to within the vacuum chamber even when the squeegees and end guides are all seated against the surfaces to be cleaned. Further, the seated squeegees and end guides act to contain the spray to prevent it from spreading out beyond the tool itself; and the squeegees act equally well in wiping the surfaces dry upon back-and-forth stroking movement of the tool, in either direction paralleling the corner. The effective cleaning action, and the effective liquid containing and cleanup action, allow the tool to be used to clean the corners and adjacent surfaces effectively and relatively effortlessly with few strokes. The tool will be particularly benefical in the commercial cleaning service industry, and for cleaning the typically difficult to reach and clean baseboard corner between a tile floor and a tile wall.

What I claim for my invention is:

1. For use with a spray-vacuum cleaning system having a source of high pressure cleaning liquid and a source of vacuum, and including a hollow wand, an improved spray-vacuum tool to clean an interior corner defined between two meeting surfaces, comprising the combination of a housing open-sided on two adjacent faces and defining an interior cavity, and a partition dividing the cavity into adjacent liquid and vacuum chambers each open to both open housing faces;

a pair of squeegees secured to and projected beyond the open housing faces from opposite housing sides paralleling the partition;

each squeegee having wiping edges that meet across a sharp exterior angle corresponding to the interior corner angle between the surfaces to be cleaned;

a pair of end guides also secured to and projected beyond the open housing faces from the other interconnecting housing sides;

said end guides also extending slightly beyond the ends of the squeegees and the squeegees extending at their ends to be substantially flush against the end guides;

said end guides projecting from the housing somewhat less than the squeegees do, and each end guide having a flat edge adapted to be fitted flush against one of the respective surfaces to be cleaned, whereupon the squeegees simultaneously contact the surfaces to be cleaned and are then somewhat flexed;

the end guides and squeegees being operable together then to isolate the chambers from the exterior of the cleaning tool while communicating the chambers together in the region adjacent the corner and surfaces to be cleaned;

nozzle means in the liquid chamber operable to spray the liquid directly into the corner and against the surfaces to be cleaned; and means to swivel the tool housing relative to the hollow wand and to communicate the source of the vacuum with the vacuum chamber.

2. A cleaning tool according to the combination of claim 1, further including brush means supported in the housing cavity immediately adjacent the squeegee disposed adjacent the liquid chamber and adapted to engage the surfaces to be cleaned.

3. A cleaning tool according to the combination of claim 2, wherein said brush means has bristles that terminate along substantially straight edges that meet across a right-angled exterior corner, and are adapted to directly hit the surfaces to be cleaned clear into the corner.

4. A cleaning tool according to the combination of claim 3, wherein the brush means is formed by a cylindrical brush located immediately adjacent the corner and straight brushes located outwardly adjacent the cylindrical brush, the straight brushes having parallel bristles projecting generally normal to the surfaces to be cleaned and the cylindrical brush having radial bristles angled relative to the surfaces to be cleaned at and across the corner.

5. A cleaning tool according to the combination of claim 4, further providing the means to swivel the tool housing relative to the wand has the wand exiting from the tool adjacent the vacuum chamber, whereupon the brush means and squeegee for the liquid chamber are located on the side of the tool remote from the wand.

6. A cleaning tool according to the combination of claim 5, wherein the cleaning liquid is carried in a line between the source and the tool, and further including a quick disconnect coupling provided in the liquid line and having separable parts remaining respectively with the wand and with the tool.

7. A cleaning tool according to the combination of claim 5, further providing cutouts formed in each flat edge of the end guides.

8. A cleaning tool according to the combination of claim 5, wherein the end guides extend between 0.05 and 0.2 inches beyond the ends of the squeegees.

* * * * *